United States Patent [19]

Westeren et al.

[11] Patent Number: 4,573,667

[45] Date of Patent: Mar. 4, 1986

[54] APPARATUS FOR QUENCHING SUBSTANTIALLY FLAT WORKPIECES

[75] Inventors: Herbert W. Westeren, Barrington; Ronald A. Harrison, Cranston; Vartan M. Tavitian, Providence, all of R.I.

[73] Assignee: C. I. Hayes Inc., Cranston, R.I.

[21] Appl. No.: 670,638

[22] Filed: Nov. 13, 1984

[51] Int. Cl.[4] ..... C21D 1/62

[52] U.S. Cl. ..... 266/114; 266/117; 266/134; 266/259; 266/260

[58] Field of Search ..... 266/114, 134, 117, 259, 266/260; 432/77, 85

[56] References Cited

U.S. PATENT DOCUMENTS

| | | | |
|---|---|---|---|
| 2,309,518 | 1/1943 | Luers | 266/260 |
| 2,396,940 | 3/1946 | Carson | 266/260 |
| 2,480,573 | 8/1949 | Hall | 266/260 |
| 2,768,595 | 10/1956 | Kalbow et al. | 266/260 |
| 2,974,941 | 3/1961 | Hobdell | 266/260 |

FOREIGN PATENT DOCUMENTS

| | | | |
|---|---|---|---|
| 10699 | of 1893 | Fed. Rep. of Germany | 266/260 |
| 3208242 | 10/1982 | Fed. Rep. of Germany | 266/260 |

*Primary Examiner*—Christopher W. Brody
*Attorney, Agent, or Firm*—Salter & Michaelson

[57] ABSTRACT

An apparatus for rapidly quenching substantially flat metal workpieces which have been heated during a heat treatment process is disclosed. The apparatus comprises a substantially flat plate having a plurality of vapor relief apertures therein, a wick element which overlies the plate so that it substantially covers the apertures, and means for supplying a coolant such as water, to the wick element so that the coolant is substantially evenly dispersed therein. The apparatus is operable for urging a heated workpiece into face to face engagement with the wick element to effect intimate contact between the workpiece and the coolant in the wick element. As soon as the workpiece contacts the coolant in the wick element, at least a portion of the coolant is substantially instantaneously vaporized to effect rapid cooling of the workpiece, the vaporized portion of the coolant escaping from the wick element through the relief apertures in the plate so that it does not impede the quenching process. The apparatus is operable for rapidly and uniformly cooling a substantially flat metal workpiece through the hardening range of the metal from which it is constructed to enhance the hardness, flexibility, and durability of the metal.

16 Claims, 6 Drawing Figures

APPARATUS FOR QUENCHING SUBSTANTIALLY FLAT WORKPIECES

BACKGROUND AND SUMMARY OF THE INVENTION

The instant invention relates to the heat treatment of metals, and more particularly, to an apparatus for rapidly quenching substantially flat metal workpieces which have been heated during a heat treatment process.

It is well known in the field of metallurgy that certain metals undergo phase changes when they are heated and cooled within certain temperature ranges. It is also known that the rate at which a metal article is cooled can have a significant effect on the phase changes which the metal of the article undergoes as it is cooled, and that as a result, certain physical properties of the metal can often be controlled or altered to a significant degree by cooling the article at a rate which produces a selective phase change. It has been found that this phenomenon applies to articles made of many metals and metal alloys and that it is particularly applicable with respect to articles fabricated from various carbon steels. Specifically, it has been found that the durability, flexibility, and hardness of carbon steel items are substantially enhanced when the items are heat treated in a manner which produces a phase change, wherein the carbon steel is transformed from a structural form known as austenite to a form known as martensite. Further, since carbon steel is a relatively inexpensive and highly desirable construction material for many items such as hardware items, the effective heat treatment of carbon steel items has particular significance. While the specific characteristics of each particular steel composition are different, generally each steel composition has a specific hardening range, and generally in order to achieve the desired phase change in an item made from carbon steel, the article must be cooled through its entire hardening range in a fraction of a second. Since the hardening ranges of carbon steels generally encompass several hundred degrees fahrenheit, this means that a carbon steel article must be cooled at an extremely rapid rate to achieve the desired change to martensite. For example, when heat treating articles made of carbon steel 1075, the articles must be cooled from a temperature of approximately 1400° F. to a temperature of approximately 1000° F. in well under one second in order to achieve the correct phase change.

While various quenching apparatus have been heretofore available for rapidly cooling metal articles, at rates which produce phase changes in the materials from which the articles are constructed, a particular problem is presented when cooling substantially flat metal articles. In this connection, it has been found that many metals undergo dimensional changes as well as phase changes when they are passed through their respective hardening ranges and that frequently if a metal article is cooled non-uniformly, different portions of the article can undergo different dimensional changes. Hence, if a substantially flat metal article is cooled non-uniformly, certain portions of the article can undergo greater dimensional changes than other portions of the article, and as a result, the article can become warped. Further, it has been found that since the surface to mass ratio of a substantially flat article is greater in the edge portions thereof than it is in other portions of the article, the edge portions tend to naturally cool at a faster rate than other portions of the article. Hence, if the article is cooled by immersing it in cooling fluid, the article is cooled unevenly and a certain amount of warping generally results. Similar effects are experienced when substantially flat metal articles are cooled non-uniformly in other areas thereof. For this reason, in order to effectively quench a substantially flat metal article, the article should be uniformly cooled and substantially all of the heat which is withdrawn from the article should be withdrawn through the surfaces on the opposite faces thereof, and the amount of heat which is withdrawn through the edge of the article should be minimized. Further, the article should be cooled at a rate which produces the desired phase change in the metal from which the article is constructed.

The instant invention provides a quenching apparatus which can be effectively utilized for uniformly cooling substantially flat metal articles at extremely rapid rates. More specifically, the apparatus of the instant invention can be utilized for effectively cooling a substantially flat metal article at a rate which generally allows the article to be cooled through the entire hardening range of the metal from which it is constructed in a fraction of a second. For example, a substantially flat article made of carbon steel can generally be cooled from a temperature of approximately 1550° to a temperature of approximately 1000° in well under a second utilizing the apparatus of the instant invention. Further, the apparatus is operative for cooling a substantially flat metal article so that substantially all of the heat which is withdrawn from the article is withdrawn through the side faces thereof and very little heat is withdrawn from the edges of the article. Hence, the apparatus of the instant invention can be effectively utilized for cooling a substantially flat metal article in a heat treatment process to achieve a desired phase change in the material from which the article is constructed without causing the article to become warped.

The apparatus of the instant invention generally comprises a substantially flat first plate having a plurality of spaced apertures therein, an absorbent first wick element which overlies a surface of the first plate, means for supplying a liquid coolant to the wick element so that the coolant is absorbed by and dispersed in the wick element, and means for urging a heated workpiece into face to face pressurized engagement with the wick element to effect intimate contact between the workpiece and the coolant which is dispersed in the wick element. The coolant which is supplied to the wick element has a temperature and a vaporization temperature which cause at least a portion of the coolant to be substantially instantaneously vaporized upon contact thereof with the heated workpiece to effect cooling of the workpiece by means of the latent heat of vaporization of the coolant. The vaporized coolant which is produced as the workpiece is cooled escapes through the apertures in the plate to prevent the formation of pockets of vapor adjacent the surface of the workpiece which could retard the cooling operation and cause the workpiece to be cooled unevenly. Further, in the preferred embodiment of the apparatus, vacuum is applied to the apertures in the plate to enhance the withdrawal of vaporized coolant from the wick element. Preferably, the means for urging a workpiece into pressurized engagement with the wick element on the first plate comprises a second plate which is substantially parallel to the first plate and movable toward the first plate for urging the workpiece into pressurized engagement with the first plate wick element between the first and second plates. In one embodiment of the apparatus, the second plate is internally cooled and it is directly engageable with a workpiece to urge it into pressurized engagement with the wick element on the first plate. Since this embodiment only includes a wick element on the first plate, preferably this form of the invention is used for cooling relatively thin workpieces where a sufficient amount of heat can be withdrawn from a workpiece through one side surface thereof. In another embodiment of the apparatus, the second plate also has a plurality of apertures therethrough, a second wick element is provided overlying a surface of the second plate which is opposite the first plate and means is provided for supplying coolant to the second wick element. Since this embodiment of the apparatus is operative for cooling substantially flat workpieces between a pair of wick elements, it can be utilized for cooling workpieces having somewhat greater thicknesses where it is necessary to effect cooling from both side surfaces of the workpieces in order to reduce the temperatures thereof at the desired rates.

The plates of the apparatus of the instant invention are preferably substantially parallel and they can be either horizontally disposed or non-horizontally disposed. Further, it is contemplated that the means for supplying coolant to the plates will be embodied in several different forms. When the plates are non-horizontally disposed, the means for supplying coolant to at least one of the plates preferably comprises a weir which is disposed adjacent an upper edge of the respective plate and means for supplying coolant to the weir. Accordingly, during the operation of the apparatus, coolant spills from the weir onto the wick element so that it gravitates downwardly therethrough and is substantially uniformly dispersed therein. When the plates are horizontally disposed, the means for supplying coolant to one or both of the wick elements preferably communicates with the wick elements through coolant apertures which are preferably disposed in substantially uniform array on the respective plates. In both of these embodiments, however, the coolant which is utilized in the apparatus preferably comprises water because water has a relatively high latent heat of vaporization and it is instantaneously vaporized when it contacts a workpiece which is heated to a temperature in the temperature range required for heat treating metals. Water is also preferable for various other well known practical reasons, although it may be desirable in some instances to add various additives to water to inhibit rust and/or corrosion. In the preferred embodiment of the apparatus of the instant invention, means is also provided for positioning a workpiece between the plates after it has been heated but before it is quenched. Specifically, means is provided for positioning a workpiece so that it is interposed in substantially parallel spaced relation between the first and second plates and the wick elements thereon before the plates are moved together. Accordingly when the second plate operates to urge the workpiece into pressurized engagement with the wick element on the first plate, the workpiece is substantially parallel to the wick element on the first plate and the surface of the workpiece which faces the wick element on the first plate is uniformly moved into engagement therewith so that the workpiece is substantially uniformly cooled during the quenching process.

It is seen therefore that the instant invention provides an effective apparatus for quenching substantially flat metal workpieces during a heat treatment process. The apparatus utilizes one or more wick elements which are saturated with a coolant to effect extremely rapid cooling of a workpiece. Further, vapors which are produced during the quenching process escape from the wick elements through the apertures in the respective plates so that they do not impede the quenching process and in the preferred embodiment these vapors are withdrawn under vacuum. Further, because the apparatus is operative with a wick element which engages a side surface of a workpiece, substantially all of the cooling is uniformly effected through the side surface of the workpiece and only minimal cooling takes place through the exposed edges thereof, and hence, the workpiece is cooled uniformly and warping is avoided. Further, because of the unique manner in which the apparatus is operative to effect quenching, a workpiece can normally be cooled through the entire hardening range of the material from which it is constructed within a fraction of a second.

Accordingly, it is a primary object of the instant invention to provide an apparatus for quenching substantially flat metal workpieces in a heat treatment process.

Another object of the instant invention is to provide an effective apparatus for uniformly quenching a substantially flat carbon steel workpiece so that it can be cooled through its entire hardening range within a fraction of a second.

A still further object of the instant invention is to provide an effective apparatus for quenching a substantially flat metal workpiece, wherein cooling is effected through the use of a wick element which is saturated with a coolant.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE INVENTION

Figure 1:
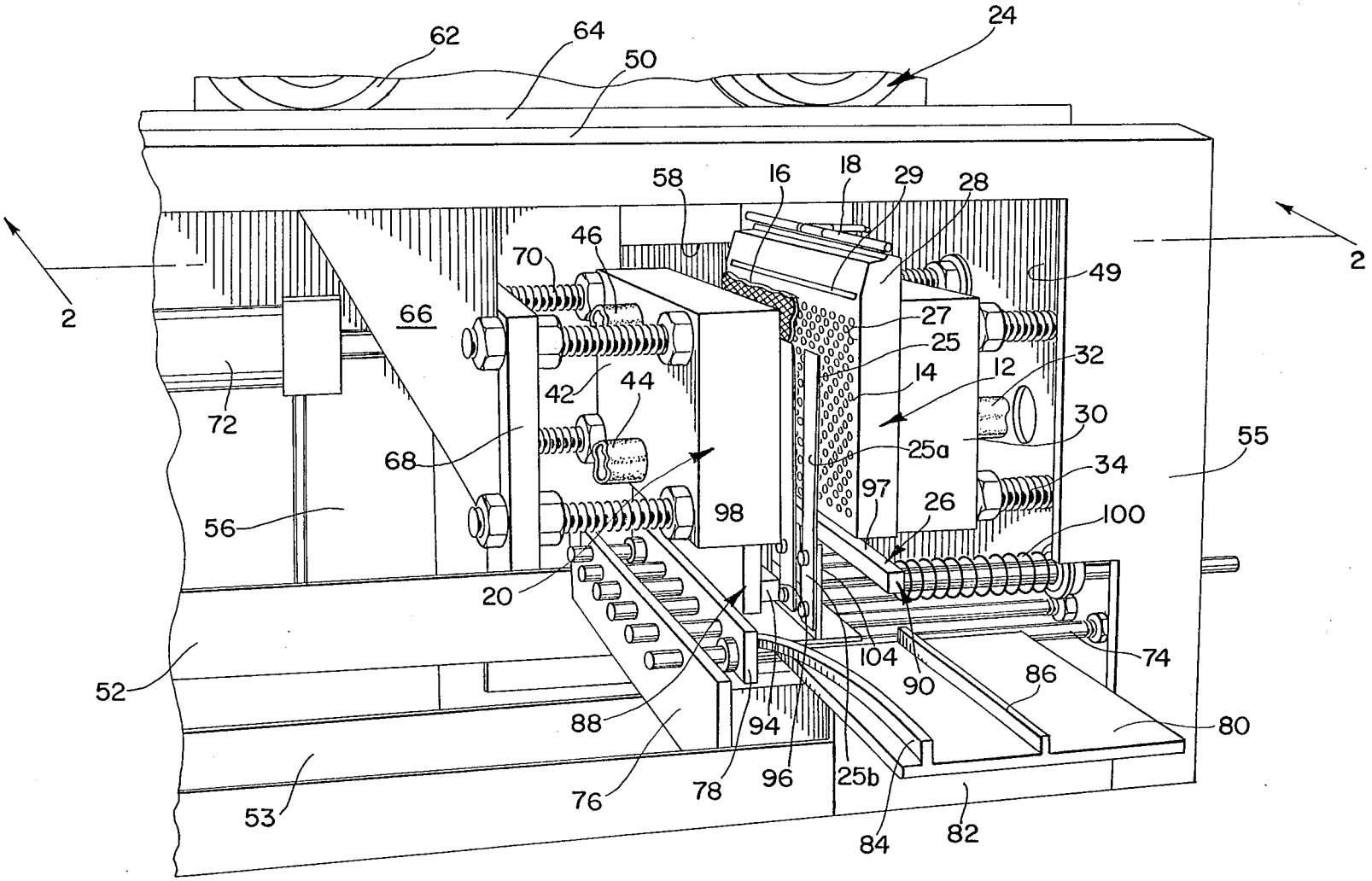
FIG. 1 is a perspective view of a first embodiment of the apparatus of the instant invention.
Figure 2:
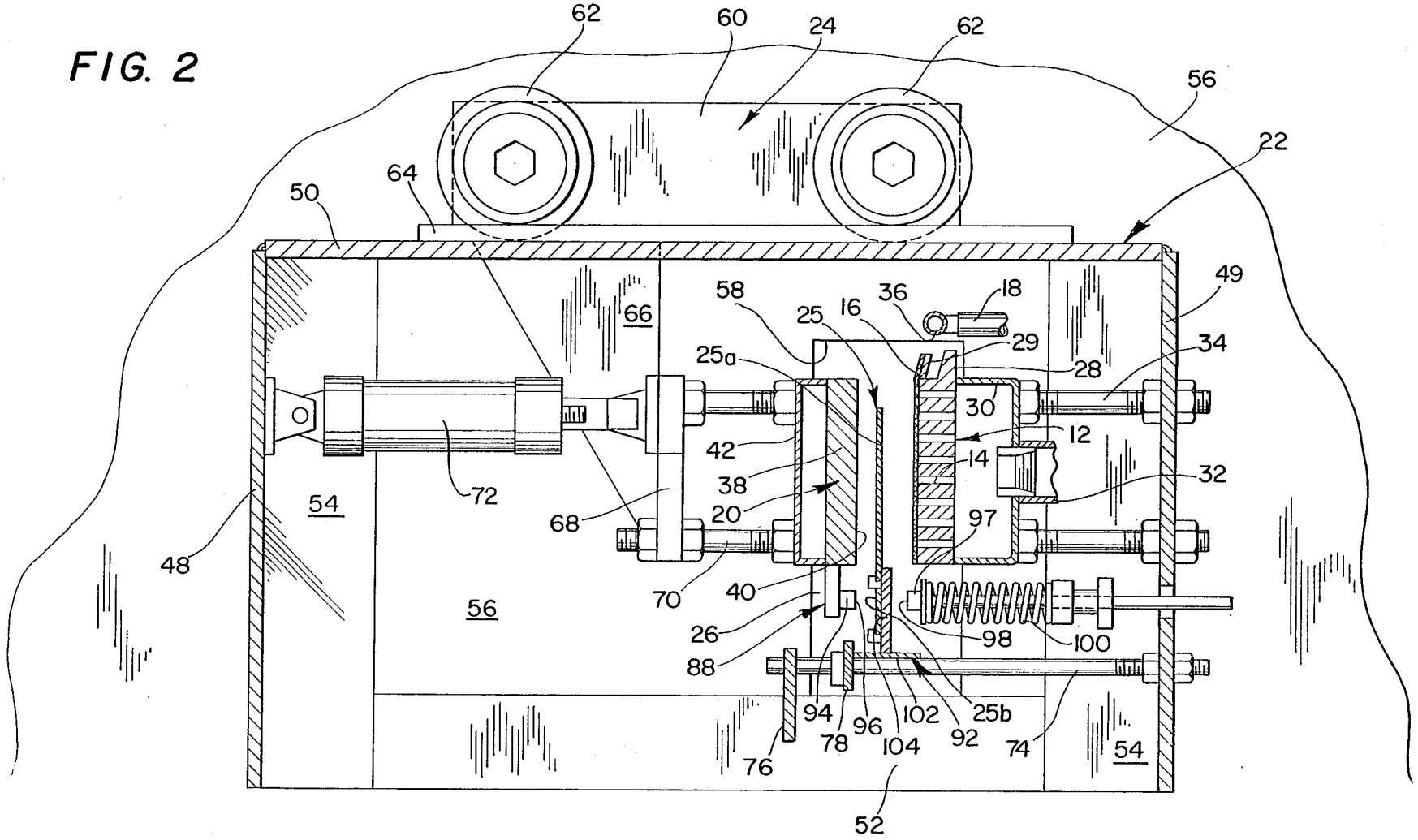
FIG. 2 is a sectional view taken along line 2—2 in FIG. 1.

Referring now to the drawings, a first embodiment of the apparatus of the instant invention is illustrated and generally indicated at 10 in FIGS. 1 and 2. The apparatus 10 comprises a first plate generally indicated at 12 having a plurality of vapor relief apertures 14 therethrough, a wick element 16 which overlies a surface of the plate 12 so that it covers substantially all of the apertures 14 therein, a coolant supply manifold 18 for supplying a liquid coolant to the wick element 16, and a second plate generally indicated at 20. The first and second plates 12 and 20, respectively, are mounted in a housing generally indicated at 22, the first plate 12 being permanently mounted in substantially stationery relation. The second plate 20 is suspended from a movable carriage assembly that is generally indicated at 24 and that is mounted on the top of the housing 22 wherein the second plate 20 is laterally movable toward and away fron the fixed first plate 12. The apparatus 10 is operative for quenching a plurality of substantially flat metal workpieces 25, which are herein embodied as putty knife blades, at an extremely rapid rate during a heat treatment process. More specifically, the blades 25, which are preferably made of a carbon steel and which, as shown more clearly in FIG. 2, include main blade portions 25*a* and handle portions 25*b*, are quenched so that the main blade portion 25*a* thereof are rapidly cooled to achieve enhanced hardness flexibility and durability therein. In this connection, the carriage assembly 24 is operable to move the second plate 20 laterally toward the fixed first plate 12 in order to urge the workpieces 25 into pressurized engagement with the wick element 16 so that they intimately contact coolant which is dispersed therein for quenching the workpieces 25 at a rapid rate. During this process, vapors which are produced as the coolant is contacted by the hot workpieces 25, escape through the vapor relief apertures 14 so that they do not impede the quenching process.

As shown in FIG. 1, the first plate 12 is preferably formed in a generally rectangular configuration from a relatively heavy guage metal, such as steel, and it includes a substantially flat working face 27 through which the vapor relief apertures 14 extend. As more clearly illustrated in FIG. 2, the plate 12 is substantially vertically disposed in the apparatus 10 and a trough-like weir section 28 is integrally formed with the plate 12 along the upper edge thereof. The weir section 28 has an elongated slot 29 formed therein for dispensing coolant therefrom so that the coolant is absorbed by the wick element 16 and gravitates downwardly therein. Extending from the plate 12 on the side thereof which is opposite from the working face 27 is a vacuum manifold 30 to which a vacuum line 32 is connected. The vacuum line 32 is connected to a vacuum source (not shown) for applying vacuum to the manifold 30 during the operation of the apparatus 10 in order that vapors, which are produced in the wick element 16 during a quenching operation by the heat of the workpieces 25, are drawn through the apertures 14 and then through the manifold 30 into the line 32. The manifold 30 is mounted on a wall of the housing 22 by studs 34 to also mount the first plate 12, the studs 34 being adjustable in order to orient the face 27 of the plate 12 in a substantially vertical position.

The wick element 16 is also preferably of substantially rectangular configuration and it is preferably made of an absorbent, relatively heavy guage, woven fiberglass cloth. The wick element 16 is received on the working face 27 of the first plate 12 so that it covers substantially all of the apertures 14 therein. The wick element 16 is retained on the surface 26 by means of vacuum which is applied to the wick element 16 through the vapor relief apertures 14 and the manifold 30.

The coolant supply manifold 18 is preferably constructed in a tubular substantially T-shaped configuration and connected to a supply of coolant. The coolant manifold 18 extends in slightly spaced relation above the weir section 28 and it has a plurality of downwardly facing apertures 36 (FIG. 2) therein for discharging coolant into the weir section 28 during operation of the apparatus 10. The coolant is supplied to the manifold 18 in a liquid state and preferably it has a temperature and a vaporization temperature which cause at least a portion thereof to be substantially instantaneously vaporized when it is contacted by the hot workpieces 25. For obvious practical reasons, the use of water as a coolant is preferable, although it may be beneficial to add various additives to the water to reduce rust and corrosion. The second plate 20 preferably comprises a main plate portion 38 which is preferably constructed of a relatively heavy guage metal, such as steel. The main plate portion 38 has a working face 40 formed thereon, a cooling manifold 42 being connected to the side of the plate portion 38 that is opposite to the face 40. The manifold 42 communicates with a supply of coolant, such as water, through inlet and outlet cooling lines 44 and 46 for circulating a liquid coolant through the manifold 42 to cool the plate portion 38 during the operation of the apparatus 10.

The housing 22 comprises an open box-like structure having a pair of spaced substantially vertical opposite side walls 48 and 49, a pair of substantially parallel, spaced top wall sections 50, (one of which is illustrated in FIGS. 1 and 2) a pair of lower support members 52, a center lower support member 53, a pair of rear side support members 54, and a pair of front side support members 55 (one of which is illustrated in FIG. 1). The housing 22 is preferably mounted on a furnace 56, the interior of the housing 22 communicating with the heating chamber (not shown) of the furnace through an opening 58 therein, for receiving work pieces 26 between the plates 12 and 20 after the work pieces have been heated.

The carriage 24 which is most clearly illustrated in FIG. 2 comprises a chassis 60 which is supported on two pairs of spaced wheels 62 at the opposite ends thereof. The wheels 62 are mounted so that they travel in tracks 64 located on the spaced top wall sections 50 of the housing 22. The carriage assembly 24 further comprises a pair of gusset members 66 which extend downwardly from the carriage 60 between the spaced top wall sections 50 and a substantially vertical second plate mounting bracket 68 is attached to the gusset members 66 in the housing 22. The second plate 20 is adjustably mounted on the bracket 68 with the studs 70, whereby the disposition of the plate 20 can be adjusted so that the face 40 thereof is substantially parallel to the face 26 of the first plate 12. Also included in the carriage assembly 24 is a hydraulic piston assembly 72 which is connected between the bracket 68 and the adjacent wall 48 of the housing 22. The piston assembly 72 is connected to a supply of pressurized hydraulic fluid (not shown) and to a hydraulic reservoir (not shown) for moving the carriage 24 on the tracks 64 so that the second plate 20 laterally is moved towards and away from the first plate 12.

The positioning assembly 26 comprises a plurality of spaced rods 74 which extend inwardly in the housing 22 beneath the plates 12 and 20 from the side wall 49. A supporting plate 76 extends between the lower support members 52 in spaced relation to the wall 49 and the inner ends of the rods 74 extend slidably through apertures in the plate 76 for providing vertical support for the rods 74. A guide rail 78 is positioned on the rods 74 in spaced relation to the plate 76 and generally beneath the plate 20. An exit shelf 80 is supported by a bracket 82 that is attached to the front lower support member 52 and extends forwardly from the rods 74, so that the upper surface of the shelf 80 is substantially coplanar with the upper surfaces of the rods 74. An arcuate first guide member 84 extends forwardly from the rail 78 on the upper surface of the shelf 80 and a substantially straight second guide member 86 extends forwardly in spaced relation to the first guide member 84.

Figure 3:
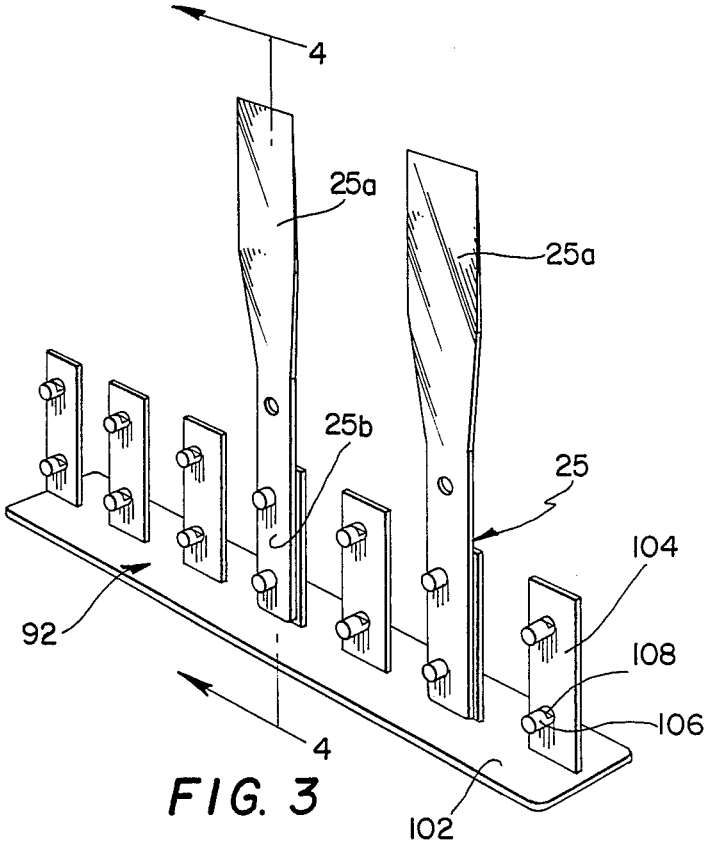
FIG. 3 is a perspective view of a plurality of workpieces as mounted on a fixture.
Figure 4:
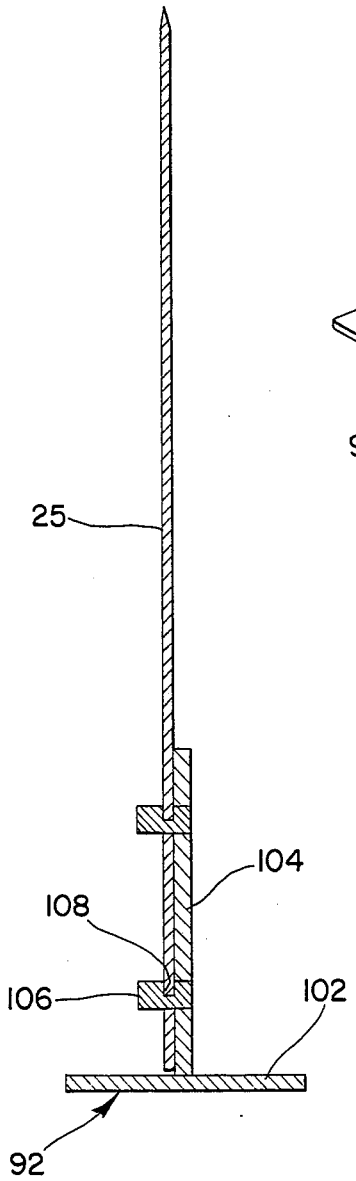
FIG. 4 is a sectional view taken along line 4—4 in FIG. 3.

Further comprising the positioning assembly 26 is a pusher bar assembly generally indicated at 88, a straightener bar assembly generally indicated at 90 and a fixture generally indicated at 92. The pusher bar assembly 88 is attached to the lower end of the second plate 20 and it includes a pusher bar 94 having a pusher face 96 thereon which is preferably substantially coplanar with the face 40 on the second plate 20. The straightener bar assembly 90 comprises a straightener bar 97 having a face 98 thereon and a pair of spaced spring loading assemblies 100. The spring loading assemblies 100 are mounted in substantially parallel spaced relation to each other on the side wall 49 of the housing 22 and they are operative for mounting the straightener bar 97 so that the face 98 thereof is in a plane which is substantially parallel to the face 27 and spaced slightly forwardly from the plane of the wick element 16, i.e. spaced toward the second plate 20 from the wick element 16, but so that the straightener bar 90 is resiliently movable a distance toward the wall 49. The fixture 92 is more clearly illustrated in FIGS. 3 and 4 and it comprises a substantially rectangular base member 102, a plurality of spaced substantially parallel tabs 104 which extend upwardly from the base member 102, and a plurality of pins 106 which are disposed in spaced pairs on the same sides of the respective tabs 104. The pins 106 have upwardly facing notches 108 therein for receiving the work pieces 25. In this connection, the workpieces 25 as herein embodied comprise putty knife blades having apertures in the handle portions **25*b* thereof which are receivable in the notches 108 in the pins 106 to position the workpieces 25 in a substantially vertical disposition on the fixture 92. It will be understood, however, that a variety of other embodiments of the fixture 92 are contemplated for accommodating other types of workpieces so that they are positioned in proper orientation for being received between the plates 12 and 20. Prior to operation of the apparatus 10, the fixture 92 is positioned on the rods 74 so that it is preferably in engagement with the rail 78. However, as the apparatus 10 is operated, the bar 88 engages the fixture 92 so that the fixture 92 and the workpieces 25 thereon are moved toward the plane of the wick element 16** as will hereinafter be more fully described.

For use and operation of the apparatus 10, coolant is fed to the weir section 28 through the manifold 18 and the coolant spills out of the slot 29 so that it gravitates downwardly through the wick element 16 and is relatively evenly dispersed therein. Vacuum is applied to the wick element 16 through the apertures 14 and the manifold 30 so that the vacuum retains the wick element 16 on the face 27 and the coolant is circulated through the plate 20 by means of the lines 44 and 46. The apparatus 10 is then fully operative for quenching substantially flat workpieces, such as the workpieces 25, after they have been heated in the furnace 56. Specifically, after the workpieces 25 which are assembled on the fixture 92 have been heated to a desired temperature in the furnace 56, the workpieces 25 and the fixture 92 are withdrawn from the furnace 56 through the opening 58 and positioned on the rods 74 so that the fixture 92 is adjacent the rail 78. The apparatus 10 is then operated to move the second plate 20 toward the first plate 12 by means of the hydraulic cylinder 72 so that the carriage 24 travels on the rails 64. As the second plate 20 approaches the workpieces 25, the face 96 of the bar 94 engages the handle portions **25*b* to urge the blades 25 and the fixture 92 toward the plane of the first plate 12. However, before the workpieces 25 engage the wick element 16, the tabs 104 of the fixture 92 engage the face 98 of the straightener bar 97 so that the tabs 104 and the handle portions 25*b* are compressed between the pusher bar 88 and the straightener bar 97 to assure that all of the workpieces 25 are oriented in substantially parallel relation to the face 27. This assures that the workpieces 25 make substantially even initial contact with the wick element 16 so that they cool evenly. As the plate 20 is further advanced towards the plate 12, the spring assemblies 100 are compressed so that the straightener bar 97 is resiliently retracted and eventually the main blade portions 25*a* of the workpieces 25 are compressed between the second plate 20 and the wick element 16. As a result, the main blade portions 25*a* of the workpieces 25 make substantially even intimate face-to-face contact with the wick element 16 and with the coolant which is dispersed therein so that the blade portions 25*a* are uniformly cooled or quenched at a highly rapid rate. The steam or vapor which is produced as the blade portions 25*a* contact the coolant is evacuated from the wick element 16 through the vapor relief apertures 14 into the housing 30 and withdrawn through the line 32. Because the workpieces 25 are aligned in substantially parallel relation to the wick element 16 before they initially engage the wick element 16, the blade portions 25*a* are uniformly cooled, and because cooling is effected through the use of a coolant which is dispersed in the wick element 16, substantially all of the cooling takes place through the side surfaces of the workpieces 25 and only an insignificant amount of cooling takes place through the edge surfaces thereof. As a result, the blade portions 25*a* of the workpieces 25** can be rapidly cooled without any significant warping and they can be cooled through the entire hardening range of the metal from which they are fabricated within a fraction of a second.

Figure 5:
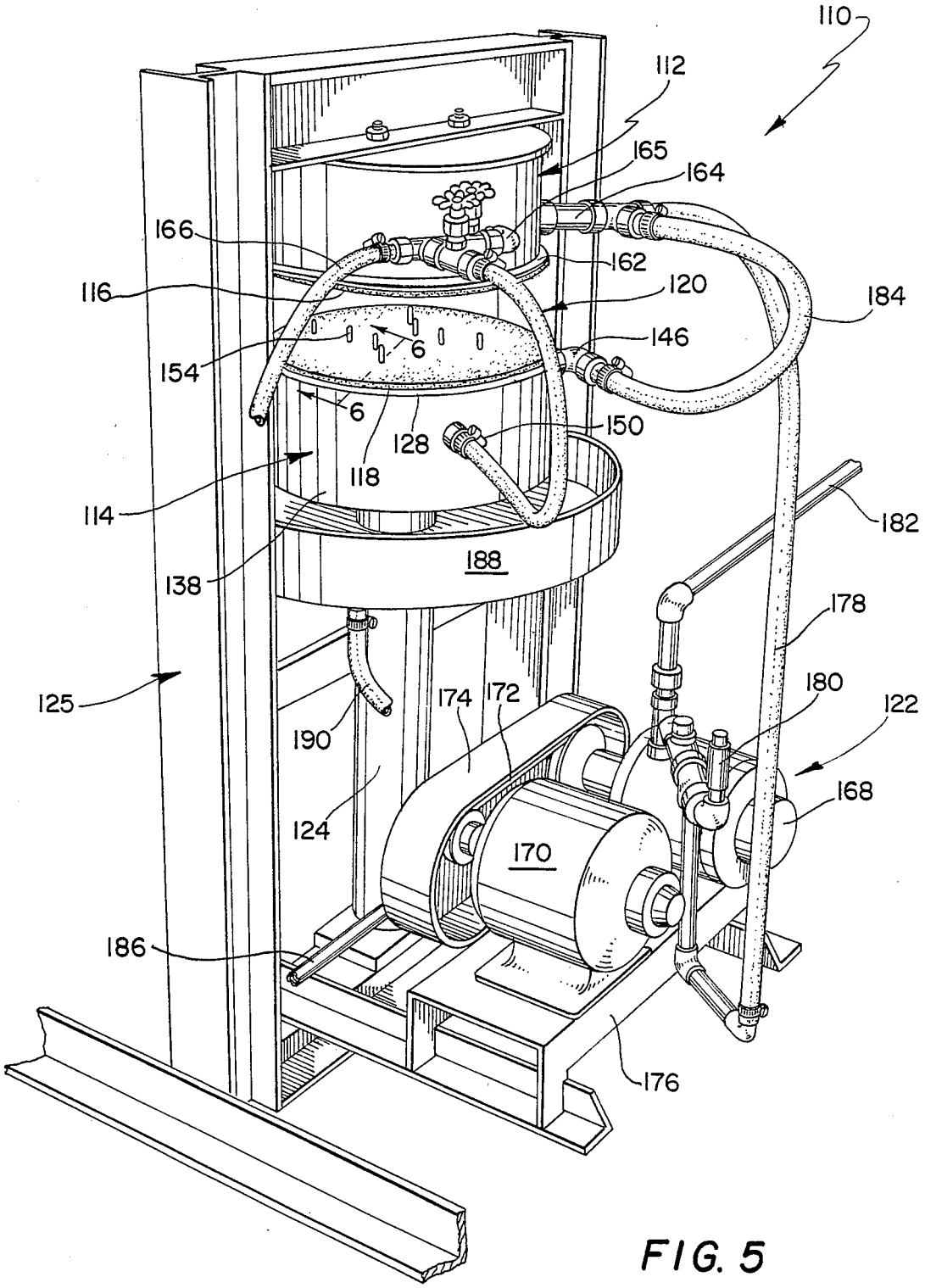
FIG. 5 is a perspective view of a second embodiment of the apparatus.
Figure 6:
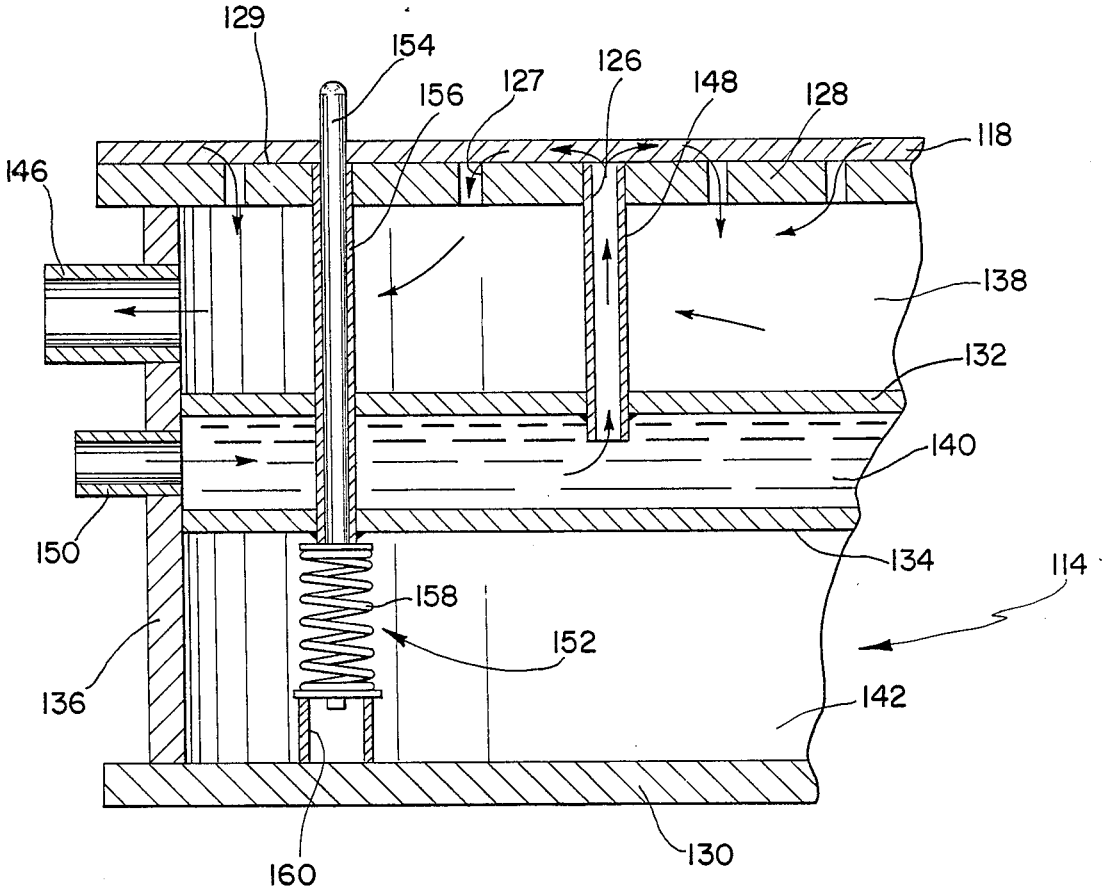
FIG. 6 is a sectional view taken along line 6—6 in FIG. 5.

A second embodiment of the apparatus of the instant invention is illustrated in FIGS. 5 and 6 and generally indicated at 110. The apparatus 110 generally comprises a pair of substantially circular upper and lower plate assemblies generally indicated at 112 and 114, respectively, a pair of upper and lower wick elements 116 and 118 which overlie opposing surfaces of the plate assemblies 112 and 114, a coolant supply network 120, a vacuum assembly generally indicated at 122, a drive assembly generally indicated at 124, and a frame assembly generally indicated at 125. The upper plate assembly 112 is mounted in stationary relation on the frame assembly 125 and the lower plate assembly 114 is mounted on the drive assembly 124. The drive assembly 124 is operative for moving the lower plate assembly 114 upwardly toward the upper plate assembly 112 so that the wick element 116 is received in mating relation with the wick element 118 and, accordingly, when a substantially flat workpiece is received on the upper surface of the lower plate assembly 114 and the drive assembly 124 is actuated to move the lower plate assembly 114 upwardly, the workpiece is compressed between the wick elements 116 and 118 on the plate assemblies 112 and 114. During operation of the apparatus 110, coolant is continuously supplied through the coolant supply network 120 to the plate assemblies 112 and 114 where it is dispersed through apertures 126 onto the wick elements 116 and 118, and vacuum is continuously applied to the wick elements 116 and 118 by the vacuum assembly 122 which communicates therewith through vacuum relief apertures 129 in the plate assemblies 112 and 114. Hence, when a work piece which has been heated in a furnace during a heat treatment process is compressed between the wick elements 116 and 118, the work piece is rapidly quenched by the coolant which is dispersed in the wick elements 116 and 118 and the vapors which are produced when the coolant contacts the hot workpiece are removed by the vacuum assembly 122.

The lower plate assembly 114 is sectionally illustrated in FIG. 6. The plate assembly 114 is in the general configuration of a circular housing and it comprises a substantially flat circular top plate 128 having a substantially flat face 129 formed thereon, a substantially flat circular lower or bottom wall 130, first and second spaced substantially flat interior plates 132 and 134, respectively, and an annular outer wall 136. The outer wall 136 extends between the top plate 128 and the bottom wall 130 and the inner plates 132 and 134 are mounted on the outer wall 136 so that first, second and third interior chambers 138, 140 and 142 are formed in the plate assembly 114. Both the vacuum relief apertures 127 and the coolant apertures 126 extend through the top plate 128 and are preferably disposed in a substantially uniform array. The apertures 127 communicate with the first chamber 138 which functions as a vacuum chamber, a vacuum outlet 146 communicating with the first chamber 138 through the outer wall 136. The first and second interior plates 132 and 134 define the second chamber 140, which functions as a coolant supply chamber. The chamber 140 communicates with the wick element 118, which overlies the face 129, by means of a plurality of coolant supply tubes 148 which extend through the plate 132, the first chamber 138 and the apertures 126 formed in the plate 128. A coolant supply fitting 150 extends through the annular outer wall 136 for supplying coolant to the second chamber 140.

Also included in the housing assembly 114 is a plurality of work piece positioning assemblies generally indicated at 152 which are operative for positioning a substantially flat workpiece in spaced relation to the wick element 118 prior to the movement of the plate assembly 114 toward the upper plate assembly 112 to quench the workpiece thereby assuring that the workpiece makes substantially even initial contact with the wick elements 116 and 118. The workpiece positioning assemblies 152 each comprise an elongated pin 154 which is guided by a sleeve 156, and a spring 158. The sleeves 156 extend from the third chamber 142 through the second chamber 140, the first chamber 138, and the plate 128, the springs 158 being mounted on the bottom wall 130 through spring mounts 160. The pins 154 are slidable in the sleeves 156 and the springs 158 position the pins 154 so that the upper terminal ends thereof normally project beyond the surface of the wick element 118. However, the pins 154 are resiliently depressable against the action of the springs 158 to positions wherein they are recessed below the surface of the wick element 118. Hence, when a work piece is positioned on the pins 154 and the plate assemblies 112 and 114 are in spaced relation, the workpiece is maintained in substantially parallel spaced relation to the wick element 118; but when the plate assembly 114 is moved toward the plate assembly 112 to compress the workpiece between the wick elements 116 and 118, the pins 154 are resiliently depressable to permit the workpiece to contact the wick element 118.

The upper plate assembly 112 is of substantially the same configuration as the lower plate assembly 114, although it does not include the positioning assemblies 152. It does, however, include an upper plate 162 which is generally similar in configuration to the plate 128 and has a plurality of vacuum relief apertures therethrough (not shown) and internal vacuum and coolant chambers (not shown) which are similar in configuration to the first and second chambers 138 and 140, respectively, and which communicate with the exterior of the upper plate assembly 112 through vacuum and coolant fittings 164 and 165, respectively.

The wick elements 116 and 118 are preferably of substantially flat circular configuration and they are preferably made of a relatively absorbent heavy woven material, such as woven fiberglass, so that coolant which is applied to the wick elements 116 and 118 can be fully absorbed and dispersed therein. The wick elements 116 and 118 are preferably of substantially the same configuration, although the wick element 118 has a plurality of apertures therethrough for accommodating the pins 154. The wick elements 116 and 118 are preferably retained on the respective plates 162 and 128 by means of vacuum which is applied thereto by the vacuum assembly 122.

The coolant network 120 comprises a network of tubular hoses 166 which interconnect the coolant supply fittings 150 and 165 to a supply of coolant, such as pressurized water. During operation of the apparatus 10, coolant is supplied to the plate assemblies 112 and 114 through the supply network 120 and distributed onto the wick elements 116 and 118 so that the coolant is relatively evenly dispersed in the wick elements 116 and 118. Preferably, the coolant which is supplied to the wick elements 116 and 118 comprises water because water is substantially instantaneously vaporized when it contacts a hot workpiece and because water has a relatively high latent heat of vaporization.

The vacuum assembly 122 comprises a vacuum pump 168, a vacuum drive motor 170, a drive belt assembly 172 which includes a protective housing 174, and a vacuum assembly base 176. The base 176 comprises a conventional base structure on which the motor 170 and the vacuum pump 168 are mounted and the drive belt assembly 172 drivingly interconnects the motor 170 to the pump 168. Also included in the vacuum assembly 122 is a main vacuum line 178 which is connected to the vacuum pump 168, a vacuum relief valve 180 which is connected to the vacuum line 178 and a vacuum discharge line 182. The main vacuum line 178 is connected to the vacuum fitting 164 on the upper plate assembly 112 and a secondary vacuum line 184 interconnects the line 178 to the fitting 146 on the lower plate assembly 112. During operation of the apparatus 110, the vacuum pump 168 is operated continuously and vacuum is applied to the upper and lower plate assemblies 112 and 114 and hence vacuum is continuously applied to the wick elements 116 and 118. The relief valve 180 prevents the vacuum in the main vacuum line 178 from going below a predetermined pressure level and vapors which are withdrawn from the plate assemblies 112 and 114 are discharged from the vacuum assembly 122 through the discharge line 182.

The drive assembly 124 comprises a conventional pneumatic piston drive assembly and it is connected through a pneumatic supply line 186 to a supply of pressurized air. The drive assembly 124 is operative in response to a predetermined pressure in the supply line 186 for moving the lower plate assembly 114 upwardly until a workpiece which is interposed between the two plate assemblies 112 and 114 is compressed between the wick elements 116 and 118. The drive assembly 124 is also operative for returning the lower plate assembly 114 to the lower inoperative position thereof illustrated in FIG. 5.

The frame assembly 125 comprises a conventional frame structure made from angle beams, "I" beams, and other conventional structural members. The plate assemblies 112 and 114 are mounted on the frame assembly 125, and the vacuum assembly 122 and the drive assembly 124 are also mounted on the frame assembly 125. Also mounted on the frame assembly 125 in the embodiment of the apparatus of the instant invention herein set forth is a catch basin 188 which is of slightly greater diameter than the lower plate assembly 114 and is mounted directly therebeneath. The catch basin 188 is provided for catching excess coolant which inadvertently drips from the wick elements 116 and 118 during the operation of the apparatus 10 and it is preferably connected to a suitable drainage outlet through a drainage line 190.

For use and operation of the apparatus 110, coolant is supplied to the wick elements 116 and 118 by means of the coolant supply network 120 and vacuum is applied to the wick elements 116 and 118 by means of the vacuum assembly 122. A substantially flat workpiece, such as a circular saw blade, which has been heated to a predetermined temperature in a heat treatment furnace and removed from the heating chamber thereof, is then positioned on the pins 154 by any convenient pusher member so that the saw blade is maintained in spaced relation to the wick element 118. The drive assembly 124 is then operated to move the lower plate assembly 114 upwardly until the pins 154 are resiliently depressed and the workpiece is compressed in face to face relation between the wick elements 116 and 118 so that it makes intimate contact with the coolant which is dispersed therein to rapidly quench the workpiece. As vapors are formed by the intimate contact of the workpiece with the coolant on the wick elements 116 and 118, the vapors are immediately withdrawn from the respective wick elements 116 and 118 by means of the vacuum assembly 122 so that the vapors do not form pockets which would insulate the workpiece and retard the quenching process. It has been found that relatively thin substantially flat metal objects can usually be quenched in less than a second, and hence the apparatus 110 has been found to be effective for quenching substantially flat carbon steel items, such as circular saw blades and the like.

It is seen therefore that the instant invention provides effective apparatus for quenching substantially flat metal workpieces. Both the apparatus 10 and 110 can be effectively utilized for quenching substantially flat metal workpieces at extremely rapid rates. As a result, both the apparatus 10 and 110 can be effectively utilized for cooling items made of materials such as carbon steel through their entire respective hardening ranges in less than a second so that the phase changes which take place in the materials from which the items are constructed can be effectively controlled. Accordingly, for these reasons as well as the other reasons hereinabove set forth, it is seen that the instant invention represents a significant advancement in the art which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. An apparatus for instantaneously and uniformly quenching a substantially flat metal workpiece after the heating of said workpiece during a heat treatment process comprising:

a. a plate having a substantially flat face thereon, said plate having a plurality of spaced vapor relief apertures therein which extend through said face;

b. an absorbent wick element overlying said face and said apertures therein;

c. means for supplying a liquid coolant to said wick element so that said coolant is absorbed by and dispersed in said wick element, said coolant having a temperature and a vaporization temperature which cause at least a portion thereof to be substantially instantaneously vaporized upon contact thereof with said heated workpiece; and d. means for urging said heated workpiece into face to face engagement with said wick element to effect intimate contact of said workpiece with the coolant dispersed in said wick element, whereupon at least a portion of said coolant is vaporized to effect the cooling of said workpiece, at least a portion of the vaporized coolant escaping through said plate apertures to prevent nonuniform cooling of said workpiece as a result of the formation of pockets of vaporized coolant between said workpiece and said wick element.

2. The apparatus of claim 1 further comprising vacuum means communicating with said vapor relief apertures for withdrawing said vaporized coolant from said wick element.

3. In the apparatus of claim 1, said plate further characterized as a first plate, said urging means further characterized as a second plate which is substantially parallel to said first plate and operable for urging said workpiece into pressurized engagement with said wick element between said first and second plates.

4. In the apparatus of claim 3, said wick element further characterized as a first wick element, said second plate having a plurality of vapor relief apertures therein, said apparatus further comprising a second wick element on said second plate, and means for supplying said coolant to said second wick element so that said coolant is absorbed by and dispersed in said second wick element, said second wick element being engageable with said workpiece to effect the face to face compressed engagement of said workpiece between said first and second wick elements, whereupon at least a portion of the coolant dispersed in said second wick element is also vaporized to effect the cooling of said workpiece, the coolant vaporized from said second wick element escaping through said second plate vapor relief apertures.

5. In the apparatus of claim 3, said first and second plates being non-horizontally disposed, said means for supplying coolant to said first plate comprising a weir and means for supplying coolant to said weir, said coolant spilling from said weir, passing to an upper portion of said wick element, and gravitating downwardly through said wick element so that it is dispersed therein.

6. In the apparatus of claim 3, said first and second plates being non-horizontally disposed, said first plate having an upper edge, said wick element extending substantially to said upper edge, said means for supplying said coolant to said first plate comprising a weir adjacent said upper edge and means for supplying said coolant to said weir, said coolant spilling from said weir adjacent said upper edge, being absorbed by said wick element adjacent said upper edge, and gravitating downwardly through said wick element so that it is dispersed therein.

7. The apparatus of claim 5 further comprising means for positioning said workpiece in substantially parallel spaced relation to said first plate wick element before it is urged into engagement therewith so that said workpiece makes substantially even initial contact with said first plate wick element.

8. In the apparatus of claim 2, said vacuum means also being operative for retaining said wick element on said plate face.

9. In the apparatus of claim 1, said coolant comprising water.

10. In the apparatus of claim 3, said second plate being internally cooled.

11. In the apparatus of claim 5, said first and second plates being substantially vertically disposed.

12. In the apparatus of claim 3, said first and second plates being substantially horizontally disposed, said apparatus further comprising means for positioning said workpiece in substantially parallel spaced relation to said first plate wick element before it is urged into engagement therewith so that said workpiece makes substantially even initial contact with said first plate wick element.

13. In the apparatus of claim 12, said second plate being disposed above said first plate, said positioning means comprising a plurality of resiliently depressable pins which project upwardly from said first plate beyond the upper surface of said first plate wick element, said workpiece being receivable on the upper terminal ends of said pins to position it in substantially parallel spaced relation to said first plate wick element.

14. In the apparatus of claim 1, said plate having a plurality of spaced coolant supply apertures therein, said coolant supply means supplying said coolant through said coolant supply apertures.

15. In the apparatus of claim 13, said coolant supply apertures being disposed in substantially uniform arrays in said first and second plates.

16. In the apparatus of claim 1, said vapor relief apertures being disposed in a substantially uniform array in said plate.

* * * * *